US005605145A

United States Patent [19]

Hannah et al.

[11] Patent Number: 5,605,145

[45] Date of Patent: Feb. 25, 1997

[54] MICROPHONE ATTENUATION DEVICE FOR USE IN OXYGEN BREATHING MASKS

[75] Inventors: Gary R. Hannah, Merriam; Randy G. Stratman, Prairie Village, both of Kans.

[73] Assignee: Puritan-Bennett Corporation, Overland Park, Kans.

[21] Appl. No.: 503,667

[22] Filed: Jul. 18, 1995

[51] Int. Cl.[6] ..... A62B 18/08

[52] U.S. Cl. ..... 128/201.19; 128/204.26; 200/81.9 M; 381/94; 381/187

[58] Field of Search ..... 128/201.19, 200.29, 128/200.24, 205.25, 204.26, 206.21; 381/168, 169, 187, 94; 379/175; 200/81.9 M

[56] References Cited

U.S. PATENT DOCUMENTS

| | | | |
|---|---|---|---|
| 3,347,229 | 10/1967 | Heitman et al. | 128/201.19 |
| 3,415,245 | 12/1968 | Yamamato et al. | 128/201.19 |
| 3,850,168 | 11/1974 | Ferguson et al. | 128/206.27 |
| 4,736,740 | 4/1988 | Parker et al. | 128/201.19 |
| 4,799,263 | 1/1989 | Banziger et al. | 381/94 |
| 5,021,619 | 6/1991 | Hutchinson | 200/81.9 M |
| 5,113,308 | 5/1992 | Takeda | 361/178 |
| 5,159,641 | 10/1992 | Sopko et al. | 128/201.19 X |
| 5,183,983 | 2/1993 | Knop | 200/81.9 M |
| 5,307,793 | 5/1994 | Sinclair et al. | 128/201.19 |
| 5,422,616 | 6/1995 | Jackman | 335/205 |

FOREIGN PATENT DOCUMENTS

| | | | |
|---|---|---|---|
| 94/05372 | 3/1994 | WIPO | 128/201.19 |

*Primary Examiner*—V. Millin
*Assistant Examiner*—Eric P. Raciti
*Attorney, Agent, or Firm*—Fulwider Patton Lee & Utecht

[57] ABSTRACT

A microphone signal attenuating breathing mask body having a gas port for inhalation of a gas to the wearer in a flow stream therethrough. A demand microphone is mounted to the mask and is coupled to an electromagnetic switch responsive to a predetermined magnetic field for switching from an actuation to an attenuation position to block transmission of sound from the microphone. An air vane is pivotally mounted on the mask body and is formed with an impingement pad positioned in the flow stream and mounts an activating magnet disposed adjacent the switch. The vane is normally disposed in a normal position such that the magnet is in an activating position and the electromagnetic switch is in the actuation position such that the microphone is active for transmission of audio signals. Upon inhalation by the wearer, the vane is responsive to the impingement of the air stream on the impingement pad to move the vane to a displaced position moving the magnet to the deactivating position, switching the switch to the attenuation position to block transmission of audio signals from the microphone.

21 Claims, 4 Drawing Sheets

MICROPHONE ATTENUATION DEVICE FOR USE IN OXYGEN BREATHING MASKS

BACKGROUND OF THE INVENTION

1. Field of the Invention

The invention is generally related to aircraft oxygen breathing masks and, more particularly, to breathing masks having microphones therein.

2. Description of the Related Art

Most aircraft are equipped with breathing mask systems to supply oxygen to crew members for use in emergency situations, for instance in oxygen depleted environments during aircraft decompression. In the course of such emergency aircraft operations, pilots, navigation officers and other flight crew personnel may don a breathing mask including a demand breathing regulator and microphone system. It is imperative that the breathing mask include a microphone so that communication with other crew members or with control tower personnel, during such emergency situation may be maintained.

In most microphone systems, sounds emitted by the wearer activate a microphone which converts received sounds into audio signals for transmission. The sounds received by the microphone include not only the wearer's voice but, unfortunately, background noise as well. When the wearer inhales, the sound of gas flow through the mask's breathing regulator is often particularly loud and is transmitted as noise having a large component comparable in both frequency and intensity to the sounds made by a person when speaking. When one of two or more flight crew members wearing masks is speaking, the noise generated during inhalation by others in the crew can seriously interfere with the hearing or understanding of the crew member speaking. In addition, when the crew members are exposed to stressful emergency conditions, their breathing rate is increased further intensifying the level of noise interference. This interference presents a very serious problem because it is at such time of emergency that effective communication between crew members and the tower is imperative.

Others have endeavored to overcome the noise interference by incorporating electronic filters and noise dampening means with the microphone systems. However, it has been found that such filters and dampeners also filter out the sounds of speech.

Others have provided breathing masks wherein the microphone includes a noise attenuation structure or microphone deactivation device for reducing the amount of audio signals generated from the microphone by electrically disabling the microphone during inhalation by the wearer.

One such deactivation device has been proposed which incorporates a pair of normally closed contacts carried on a leaf spring, connected in series with the microphone and coupled with an air impingement tab disposed in the gas supply path so that incoming gas will shift such tab against the spring bias to open the contacts and disable the microphone. Such a device suffers the shortcoming that the flow of incoming air to activate the switch may lag the pilot's inhale cycle thus leaving a time lapse before the microphone is cut out when it may pick up his or her inhaling noise. Moreover, the air flow force required to overcome the bias of the contact leaf spring may be considerable and could interfere with smooth and responsive operation.

Another such deactivation device includes a normally closed electromagnetic reed switch device in circuit with the microphone. A movable magnet is disposed in the inhalation air stream of the mask to, upon movement thereof, open the reed switch to disable the microphone. Because such reed switch/magnet devices may be relatively small and require only a minimum of force to operate, such devices have been found desirable for use in breathing mask applications to minimize the bulk of the mask and minimize weight. In this deactivation device, the magnet is biased by a spring to a normal position spaced from the switch such that during exhalation when the pilot is speaking, the magnetic field of the magnet acting on the reed switch is of insufficient strength to close such switch so that the circuit for the microphone is made and voice transmission is maintained. Upon inhalation by the wearer, the air stream impinges on the magnet assembly to move the magnet against the bias of the coil spring to a position adjacent the reed switch such that the magnetic field interacts with the read switch to open the circuit disabling the microphone.

Although this reed switch/magnet configuration has proven effective in operation, certain drawbacks have been identified with regard to the spring biased magnet. In some circumstances as the coil spring is compressed or expanded, the biasing force thereof may increase as the displacement of the spring is changed. Because the volume of air stream during inhalation tapers off near the end of the inhalation cycle, the air impinging forces acting on the magnet assembly decrease. As such, the biasing force of the spring may prematurely overcome the air impinging forces and move the magnet assembly to its normal position prematurely activating the microphone before the full inhalation cycle is completed. In addition, in the case where the spring force is increased as the spring is expanded or contracted, such spring force may actually inhibit the displacement of the magnet to its operative circuit disabling position if the volume of air impinging on the magnet assembly is not sufficient. Therefore, it is desirable that the force required to move the magnet assembly decrease as the magnet assembly is moved to the circuit opening position rather than increase. Hence, those skilled in the art have recognized the need for providing a breathing mask having a microphone noise attenuation device which is effective upon inhalation by the wearer to deactivate the microphone and eliminate background and inhalation noises. Operation of the microphone noise attenuation device should be minimally affected by variations in orientations of the mask due to variations in the orientation of the wearer's head as he or she looks about in the aircraft and as the aircraft itself maneuvers about. Additionally, the noise attenuating device should incorporate a minimal number of components to facilitate rapid assembly within the breathing mask and minimize bulk. Further, the microphone attenuation device should be relatively inexpensive to manufacture and reliable in use. The present invention meets these needs and others.

SUMMARY OF THE INVENTION

Briefly and in general terms, the present invention is directed to aircraft breathing masks including a microphone for transmitting voice signals to other occupants within the aircraft, to the control tower or to other aircraft. The breathing mask includes a microphone noise attenuation device that upon inhalation of the wearer, blocks transmission of sounds from the microphone.

In accordance with the invention, a breathing mask includes a gas inlet port through which a flow stream passes for communication with the wearer's breathing passage. A microphone is coupled to the mask body for receiving sounds from the wearer to produce audio signals for transmission to others. An electromagnetic switch is coupled to the microphone to, upon being switched to an attenuation position, block the transmission of sounds by the microphone. The electromagnetic switch is responsive to a magnetic field to switch from a normal microphone actuation position to the attenuation position. An vane is movably mounted on the mask body and is formed with an impingement pad positioned in the flow stream. The vane mounts an activating magnet disposed adjacent the switch to normally maintain such switch in the actuation position such that the microphone is active for transmission of audio signals. In addition, a bias element is mounted on the body for biasing the vane to a normal position such that the magnet is disposed in the actuation position. Upon inhalation by the wearer, the vane is responsive to impingement of the flow stream on the impingement pad to move to a displaced position to switch the switch to the attenuation position to block transmission of audio signals from the microphone.

In a further aspect of the invention, the electromagnetic switch is mounted in a switch housing selectively movable relative to the magnet to vary the magnitude of the magnetic field applied to the electromagnetic switch.

In a further aspect of the invention, the bias element is in the form of a magnetically attractive member mounted on the mask body adjacent the magnet. The attractive member, under the influence of the magnetic field of the magnet, applies an attractive force to the magnet drawing the magnet toward the attractive member to move the vane to its normal position. When the wearer inhales and the flow stream impinges on the vane, the force of the stream is greater than the attractive force moving the vane from the normal position to the displaced position. As the magnet is moved away from the attractive member, the magnitude of the attractive force is decreased as the intensity of the magnetic field is reduced such that the magnitude of the impinging force of the flow stream required to maintain the vane at its displaced position is reduced.

Other features and advantages of the invention will become apparent from the following derailed description taken in conjunction with the accompanying drawings, which illustrate by way of example, the features and advantages of the invention.

DETAILED DESCRIPTION OF THE PREFERRED EMBODIMENTS

Figure 1:
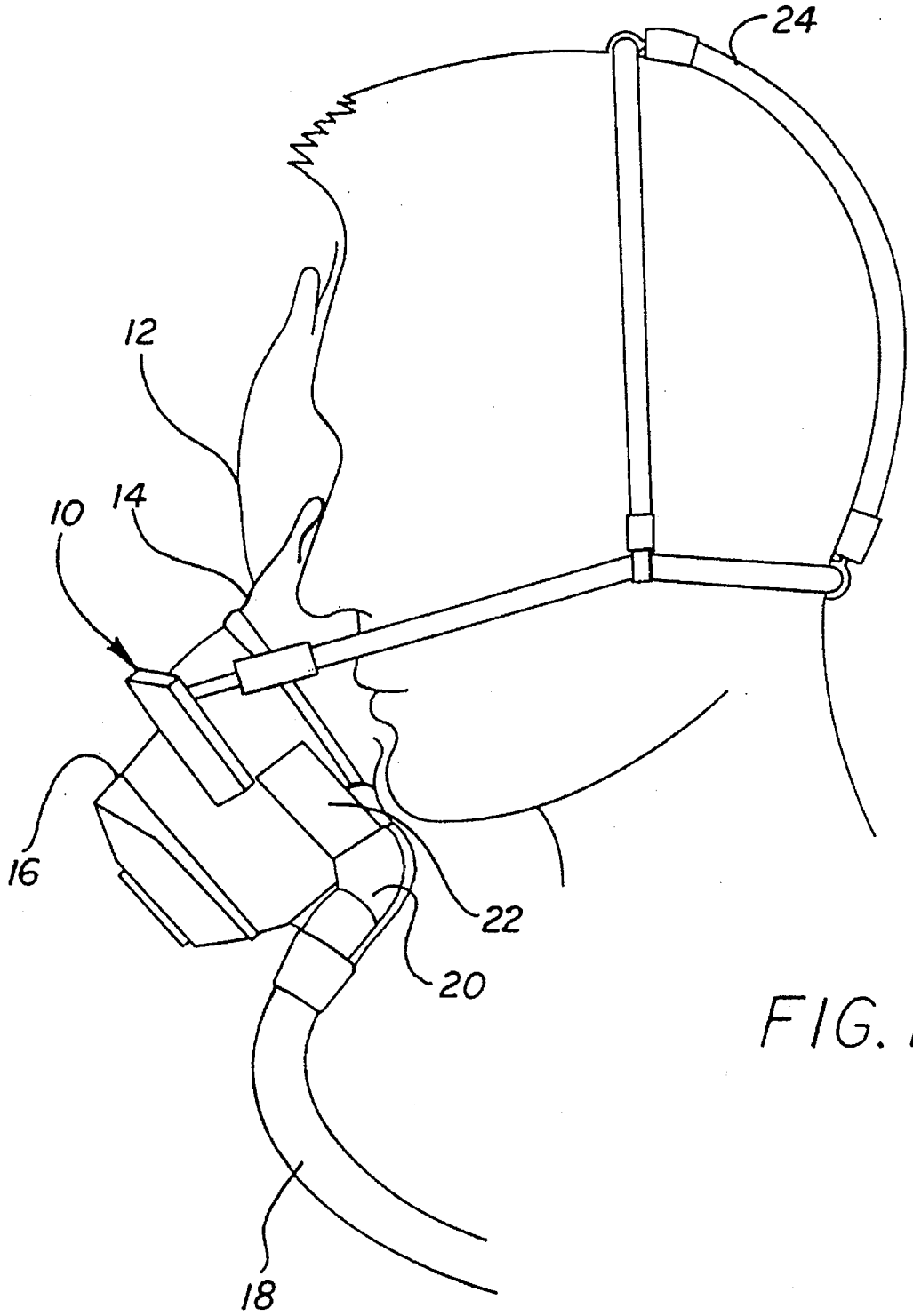
FIG. 1 is a diagrammatic side view of an aircraft breathing mask fitted on a flight crew member including therein a microphone assembly and noise attenuation device in accordance with the present invention.

In the following description, like reference numerals will be used to refer to like or corresponding elements in the different figures of the drawings. Referring to FIG. 1, a full face flexible mask 10 for use by an aircraft flight crew is provided and includes a flexible lens 12 sealingly molded into a flexible mask body 14 for sealing engagement against the wearer's face. The mask body is molded with a projecting regulator housing 16 that houses therein a conventional demand regulator assembly (not shown) for delivering breathable air such as oxygen or an oxygen/air mixture at an appropriate delivery pressure. The regulator housing receives breathable gas under pressure from a pressurized gas source by way of an inlet hose 18 and fitting 20 coupled to the regulator housing. In addition, the regulator housing has mounted thereto a microphone assembly, generally indicated at 22, nested within the mask body to convert sounds received from the wearer into audio signals for transmission to other crew members and to the control tower. An adjustable harness strap 24 is attached to the mask and mask body for conveniently adjusting the face mask conformably over the wearer's head when in use.

The microphone assembly includes a microphone therein and a microphone noise attenuating device to, upon inhalation by the wearer, deactivate the microphone to prevent communication of background and inhalation noise. The moving parts of the microphone noise attenuation device are constructed such that their operation will be relatively unaffected by variations in orientation of the mask itself due to variations in orientation of the pilot's head within the aircraft or variations in orientation of the aircraft itself. In addition, the microphone noise attenuation device incorporates a minimal number of components to facilitate rapid assembly and is relatively inexpensive to manufacture and reliable in use.

Figure 2:
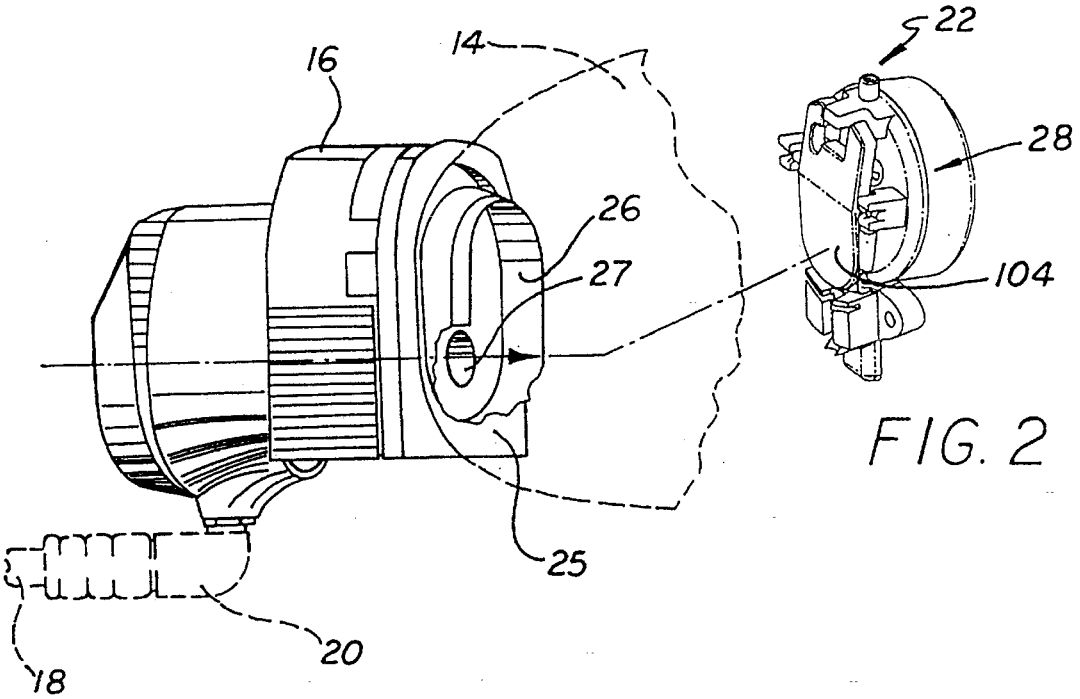
FIG. 2 is an enlarged exploded perspective view of the breathing mask and microphone assembly shown in FIG. 1.

Referring to FIG. 2, the front face of the regulator housing 16 is formed with a forwardly projecting oblong circular flange 26 configured and sized for nesting therein of the microphone assembly 22 shown separated therefrom. Terminating at the face of the regulator toward the bottom thereof is a gas inlet port 27 through which breathable air is drawn and introduced into the mask body 14. The microphone assembly is arranged such that when mounted to the regulator housing, the microphone assembly is disposed in covering relationship over such inlet port 27.

Figure 3:
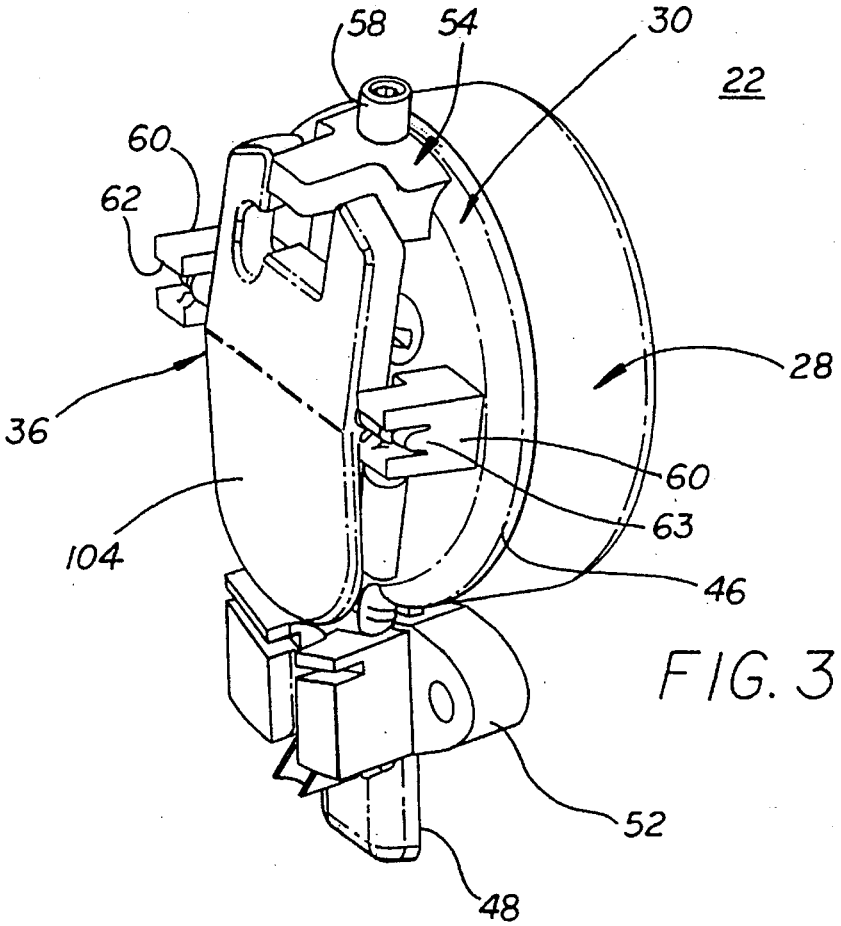
FIG. 3 is an enlarged perspective view of the microphone assembly shown in FIG. 2.
Figure 4:
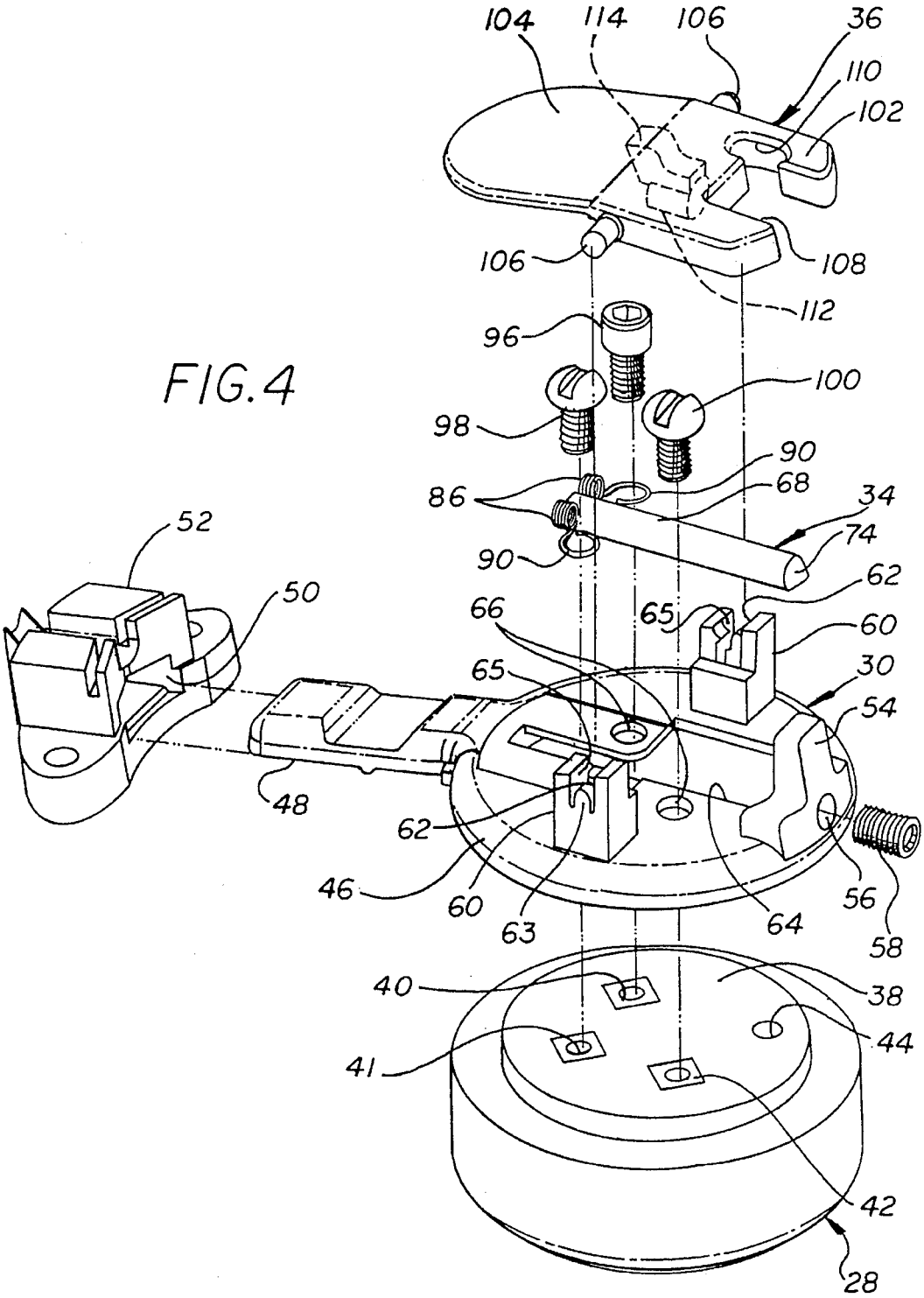
FIG. 4 is an exploded view of the microphone assembly shown in FIG. 3 and including the microphone attenuation device in accordance with the invention.

Referring now to FIGS. 3 and 4, the microphone assembly 22 briefly and in general terms, includes a cylindrical microphone housing 28, a cylindrical base 30 upon which the microphone housing is mounted, and a microphone noise attenuation device comprising an electromagnetic switch 34 mounted to the base and an air attenuation vane 36 pivotally mounted to the base. The air vane is operative to, upon inhalation of the wearer, cause the electromagnetic switch to deactivate the microphone.

With continued reference to FIGS. 3 and 4, the microphone assembly 22 will be described hereinafter in detail. The microphone assembly includes a microphone housed in the generally cylindrical microphone housing 28, the housing having a cylindrical backing plate 38. The microphone is of conventional design and may be, for instance, a carbon type microphone. The microphone receiver (not shown) is positioned at the opposite side of the housing from the backing plate and receives sounds from the wearer. The backing plate includes a pair of centrally located laterally spaced apart first and second electrically conductive inserts defining threaded bores 40 and 41 that are electrically connected to the microphone for transmitting received sounds from the receiver. In addition, a third threaded mounting bore 42 is formed in the backing plate and is spaced axially from the second conductive bore 41. In addition, the backing plate includes an access bore 44 for providing access to a set screw therein for adjusting a potentiometer contained in the microphone housing to vary microphone volume output.

Referring to FIG. 4, the base 30 is relatively thin and is formed with a generally flat circular, disk-like base portion 46 and a radially outwardly projecting tongue 48 sized for receipt within an aperture 50 formed through a mask body mounting bracket 52 configured for fixedly mounting the microphone assembly 22 to the regulator housing 16. Such cylindrical base portion 46 is sized to overlie the backing plate 38 of the microphone housing 28 and includes a projecting switch bracket 54 integrally formed at the periphery of the circular portion of the base and disposed diametrically opposite the projecting tongue. The switch bracket is arranged to adjustably mount the electromagnetic switch 34 therefrom extending vertically when the mask is upright and is formed with a threaded axial set screw bore 56 for receipt of a through threaded adjustment screw 58. Disposed on the diametrically opposite sides of the circular portion of the base are a pair of upstanding mounting ears 60 having rearwardly opening transversely aligned pivot slots 62 to which the attenuation vane 36 is pivotally mounted. Formed at the diametrical outer ends of such slots are respective semicircular axle cap stubs 63. Snap tabs 65 are formed on the opposite walls of the respective slots 62 for a purpose to be made clear hereinbelow.

As shown in FIG. 3, the circular portion 46 of the base 30 is also formed with a diametrical, rearwardly opening slot 64 for partially nesting therein of the electromagnetic switch 34. Adjacent the slot 64 are three mounting holes 66 (only two shown) aligned in complementary relationship over the mounting bores 40, 41 and 42 of the microphone housing 28.

Figure 5:
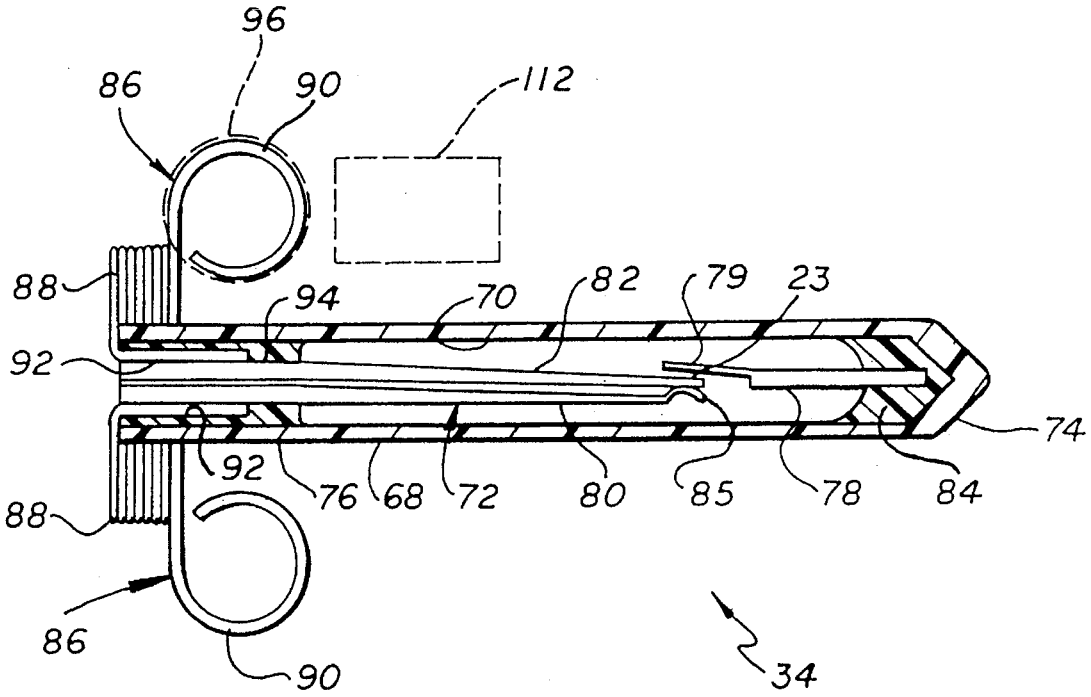
FIG. 5 is an enlarged partially sectional top view of a reed switch of the attenuation device shown in FIG. 4.

Referring particularly to FIG. 5, the electromagnetic switch 34 is generally cylindrical and includes an elongated, hollow tubular barrel 68 defining a chamber 70 and housing therein a conventional electrical reed switch 72. The barrel is formed with a closed conical distal end 74 and an open proximal end 76.

The reed switch 72 in general includes an elongated rigid stationary post 78 cantileverly mounted at one end and respective elongated stationary and movable contact members 80 and 82 cantileverly mounted from the opposite end. The post is made up of a cylindrical body and is mounted at one end within the distal end of the chamber 70 by a suitable bonding material such as soft epoxy 84 and extends proximally to terminate in a flattened abutment tab 79.

The stationary contact member 80 is constructed of rigid electrically conductive material and the movable contact member 82 of electrically conductive, flexible ferrous material. Both are generally cylindrical and taper down in the distal direction. The respective contact members 80 and 82 are received in close juxtaposed relationship generally coaxially within the chamber 70 and the stationary contact member is formed at its distal end with an inwardly curved contact hook defining a stationary contact 85 and the distal tip of the moveable member defining a movable contact 83. The respective contact members are laterally aligned with one another, but normally spaced apart, and also aligned laterally with the flat abutment tab 79.

With continued reference to FIG. 5, a pair of electrically conductive mounting springs, generally designated 86, mount the proximal ends of the respective contact members 80 and 82 and are formed by respective coil springs 88 which flank the base of the switch barrel 68 and terminate in respective orthogonally and laterally outwardly projecting mounting rings 90. The rings are sized for receipt of the shafts of mounting screws described below. Conveniently, the mounting springs terminate at their respective ends opposite the mounting rings 90 in respective L-shaped solder tabs 92 projecting into the base of the barrel 68 to be soldered to the respective proximal ends of the contact members.

A non-conductive insulator may be interposed between the respective proximal ends of the contact members 80 and 82 to insulate such proximal ends from one another. The base of the barrel 68 is then filled with an adhesive such as hard epoxy 94 to fixedly mount the contact members and mounting springs 86 to the barrel 68.

Returning now to FIG. 4, a threaded ferrous, hex socket driver mounting bolt 96, defining a bias element, and first and second mounting screws 98 and 100 are provided for receipt through respective mounting holes formed in the base 30 and threaded receipt within the respective ones of the threaded mounting bores 41 and 42 to securely mount the electromagnetic switch 34 and the microphone housing 28 to the base 30.

As shown in FIG. 4, the attenuation vane 36 is in the form of a tongue shaped plate sized to diametrically overlie the base 30 and microphone housing 28. The vane is formed with a generally rectangular upper counterbalance portion 102 and a flat semi-circularly shaped, slightly rearwardly angled impingement pad 104. The vane is configured at its longitudinal center of gravity with a horizontally extending pivot axis defined at the laterally opposite sides by laterally projecting pivot pins 106 sized for receipt within the respective pivot slots 62 of the vane brackets 60. The vane is formed in its upper extremity with an axial open ended clearance slot 108 configured to flank the lateral opposite sides of the projecting switch bracket 54, and is further formed with a laterally offset clearance slot 110 positioned for complementary alignment over the adjustment bore 44 of the microphone housing 28 such that a screw driver may pass through the offset clearance slot 110 for adjusting the potentiometer of the microphone.

Referring to FIG. 4, a generally cylindrical magnet 112 (shown in phantom) is mounted from a magnet bracket 114 affixed to the back surface of the attenuation vane 36. The magnet is axially aligned and located immediately below the level of the pivot axis defined by the pivot pins 106 and is laterally spaced to one side of the axial centerline thereof. It is to be appreciated that the attenuation vane is configured such that the axis of the pivot pins is aligned with the center of gravity of the vane to balance the vane relative to the pivot pins. The balanced vane minimizes the impact of gravitational forces acting on the vane due to aircraft orientation and head movements of the crew members wearing the breathing mask.

With reference to FIGS. 3 and 4, to assemble the microphone assembly 22, the base is positioned in overlying relationship over the backing plate 38 of the microphone housing 28 such that the mounting holes 66 are aligned over the mounting bores 40, 41 and 42. The electromagnetic switch 34 is positioned over the axial slot 64 of the base such that the distal tip 74 thereof is aligned axially with the set screw bore 56 of the switch bracket 54. The distal end of the device is inserted sufficiently far in the set screw bore to position the respective spring mounting rings 90 in vertical alignment over the respective mounting holes 66 of the base 30. The hex driver bolt 96 is inserted through a respective mounting ring 90 and in a mounting hole 66 and threadedly engaged within the first mounting bore 40 of the microphone housing 28. In a similar manner, the first mounting screw 98 is received within the other mounting ring 90 and mounting hole and threadedly engaged within the second mounting bore 41 of the microphone housing. The second mounting screw 100 is received within a respective mounting hole of the base and threadedly engaged within the third mounting bore 42. The hex driver mounting bolt and mounting screws securely mount the electromagnetic switch 34 and microphone housing to the base.

It will be appreciated that the spring mounting rings 90 are so configured that the respective mounting bolts 96 and 98 serve to maintain the electromagnetic switch 34 urged axially in the distal direction from one end of the set screw bore 56 (FIG. 4). The set screw 58 may be threadedly advanced from the opposite end of such set screw bore to abut the distal end of the barrel 68 to drive such switch a sufficient distance in the proximal direction to adjust its position relative to the activating magnet 112 to apply the desired strength of magnetic field to such switch. Electrically conductive leads (not shown) may then be coupled to the respective mounting rings 90, such that electrical continuity is provided through the hex driver bolt 96 and the first mounting screw 98 to the conductive inserts of the mounting bores 40 and 41 of the microphone housing to carry electrical signals from the microphone.

The attenuation vane 36 is then positioned over the base to align the clearance slot 108 over the switch bracket 54 and insert the pivot pins 106 in the pivot slots 62 of the respective mounting ears 60. The pivot pins may then be snapped into the pivot slots past the tabs 65 for pivotal movement therein. The tongue 48 of the base 30 may then be inserted in the aperture 50 of the mask body mounting bracket 52 and affixed therein by suitable means to complete the assembly. As can be appreciated, assembly of the microphone assembly 22 may be achieved rapidly and with minimum opportunity for error.

With reference to FIG. 5, the magnet 112, shown in phantom, is spaced from the switch 34 in an activating position such that the magnetic field thereof does not influence the movable ferrous contact member 82 thus leaving it in its normal actuation position wherein the movable contact 83 maintains contact with the contact hook 85.

In the magnet activating position shown in FIG. 5, it is to be noted that one pole of the magnet 112 is located adjacent the ferrous hex driver bolt 96 (shown in phantom). As such, the magnetic force of the magnet acts on the hex driver bolt to bias the magnet toward such bolt thereby tending to pivot the vane clockwise as viewed in FIG. 3 to a normal position. It is to be appreciated that a spring, or other suitable means, may be employed to provide such bias to pivot the vane to the normal position in a similar manner.

Referring to FIG. 2, the assembled microphone assembly 22 may now be mounted to the front face 25 of the regulator housing 16. To mount the microphone assembly to the regulator housing, the impingement pad 104 of the attenuation vane 36 is positioned in covering relationship over the inlet flow port 27 and received within the confines of the peripheral flange 26 thereof. Mounting bolts may then be received within the mounting holes of the mask body mounting bracket 52 to affix the microphone assembly to the regulator housing. The microphone leads (not shown) may then be directed from the microphone in the regulator housing and adjacent the inlet hose 18 to be connected to radio equipment.

With reference to the FIGS. 2–5, the operation of the microphone assembly 22 and the microphone attenuation device may now be described in detail. With the flexible face mask 10 and mask body 14 thereof properly located over the wearer's face and mouth, the wearer can inhale to receive gas from the regulator through the inlet flow port 27. As the wearer inhales, a gas flow stream in the direction of the arrow in FIG. 2, impinges against the impingement pad 104 on the bottom half of the attenuation vane 36 causing a pressure gradient tending to rotate such vane in the counterclockwise direction as viewed in FIGS. 2 and 3. As the pressure gradient across the vane caused by the flow stream impinging on the impingement surface 104 becomes sufficient to overcome the magnetic attractive biasing force between the magnet 112 and the hex driver bolt 96, the vane 36 will be pivoted counterclockwise about the pivot pins 106, thus carrying the magnet 112 in a small arc, in the orientation shown in FIG. 3, upwardly and rearwardly so that the vertical component of travel shifts it away from the hex driver bolt 96. As such, the magnet 112 travels with the vane in an arc away from the hex driver bolt 96 generally parallel to the vertical axis of the reed switch 72, the magnetic field generated thereby being shifted relative to the switch contact members 80 and 82 thus increasing the attractive force on the movable contact member 82.

It is noteworthy that with this construction, the magnet 112 need only be moved a distance between 0.005 and 0.015 inches to increase the attractive magnetic force on the moveable contact member 82 sufficient to flex such member and cause the moveable contact 83 to be lifted off the stationary contact 85. As the movable contact 83 brews contact with the stationary contact 85, the electrical circuit to the microphone is broken preventing any transmission of noise during the inhalation cycle.

In addition, as the vane 39 is pivoted counterclockwise from its normal position to its displaced position moving the magnet 112 away from the hex driver bolt 96, the force of the magnetic attraction or biasing force between the magnet and the hex driver bolt acting to move the vane to its normal position is decreased. Therefore, once the vane is rotated from its normal position toward its displaced position, the impingement force of the air stream required to maintain the gradient necessary to maintain the displaced position will be less than the initial force which was required to generate the gradient to move the vane from the normal position. As such, the magnitude of the flow rate through the inlet flow port 27 required to maintain the vane in its displaced position is reduced, thus accommodating the natural breathing characteristic of certain persons wherein inhalation flow rates gradually decrease toward the end of the inhalation cycle.

When the mask wearer ceases to inhale, for instance during the exhalation cycle or during speech, gas delivery from the gas inlet port 27 ceases and the impingement force of the flow stream applied against the impingement pad 104 of the attenuation vane 36 is diminished thus diminishing the pressure gradient across such pad. Thus, the magnetic attractive or biasing force between the magnet 112 and the hex driver bolt 96 will serve to draw the magnet toward the hex driver bolt pivoting the vane clockwise (FIG. 3) from the displaced position to the normal position such that the magnet is moved relative the reed switch 72 to reduce the magnetic force on the moveable contact member 82. The movable contact member 82 will then return to its normally biased position closing the electrical contact 83 on the contact hook 85 of the stationary contact member 80 to once again complete the electrical circuit of the microphone such that the microphone can receive voice signals from the wearer for transmission to other crew members and control tower personnel. In addition, because the movable contact member is normally biased to the closed contact position, should the attenuation vane become dislodged from the base 30 for any reason, the microphone will remain activated.

It is to be appreciated that the balanced support of the attenuation vane 36 upon the base 30 provides desirable operating characteristics. For instance, when operating the aircraft in emergency situations, the orientation of the airplane may change drastically causing gravitational forces to act on the attenuation vane influencing the movement thereof. In such situations it is imperative that the microphone and the attenuation device operate properly. Because the vane is balanced on the base of the microphone assembly 22, gravitational forces act on the various portions of the vane in a uniform manner thereby minimizing variations in the gravitational influences on the attenuation vane reducing the possibility of improper operation of the microphone attenuation device.

As described above, the electromagnetic switch 34 is biased under the influence of the mounting springs 86 axially in the distal direction within the set screw bore 56. The set screw 58 may be threadedly advanced within the set screw bore such that the proximal face thereof contacts the distal tip of the barrel 68 and the set screw progressively turned to apply pressure to such barrel moving it and reed switch 72 therein proximally relative to the base 30 and magnet 112 in opposition to the bias of the mounting springs. In this manner, the reed switch 72 may be adjustably positioned relative to the activating magnet 112 to vary the position of such reed switch and the resultant magnetic field on such switch. As such, the attenuation characteristics of the reed switch may be "fine tuned" to provide optimal microphone attenuation performance or to compensate for slight manufacturing tolerance defects.

Furthermore, adjustment characteristics of the magnetic attraction between the reed switch and vane magnet 112 are accomplished by shifting of the reed switch rather than by adjusting the position of the magnet relative to the reed switch. As such, any resultant shift of the center of gravity on the vane is minimized thus ensuring continued proper uniform operation of the attenuation device.

It will be clear that the resultant attenuation may be effected by electrically disabling the microphone as described above or by any other well known means such as by opening the electrical communication circuit or even by just reducing the volume of the microphone.

From the foregoing, it will be appreciated that the breathing mask microphone assembly provides a microphone noise attenuation device that upon inhalation by the wearer, eliminates background noise and noise associated with the influx of inhaled breathing air past the microphone. The microphone attenuation device is constructed such that it is minimally affected by variations in the orientation of the mask due to variations in the positioning of the wearer's head as well as in orientation of the aircraft itself.

While particular forms of the invention have been illustrated and described, various modifications can be made without departing from the spirit and scope of the invention. Accordingly, it is not intended that the invention be limited, except as by the appended claims.

We claim:

1. A microphone signal attenuating breathing mask to be placed over a wearer's face and comprising:

a mask body including a gas inlet port to be disposed in flow communication with the wearer's breathing passage for flow of a gas in a predetermined flow stream therethrough upon inhalation by said wearer;

a microphone for receiving sounds from said wearer and to produce transmissions related thereto;

an attenuation device for attenuating said transmissions by said microphone;

a reed switch coupled with said attenuation device and responsive to a magnetic field of a predetermined strength to switch from an actuation position to an attenuation position;

an activating magnet to apply said magnetic field disposed adjacent said switch and shiftable between an activating position and a deactivating position;

a movable vane pivotally mounted on said mask body mounting said activating magnet and having a normal position disposing said magnet in said activating position and a displaced position disposing said magnet in said deactivating position;

a bias element for biasing said vane to said normal position; and said vane being configured such that impingement of said predetermined flow stream thereto is effective to shift said vane to said displaced position.

2. The breathing mask of claim 1 that includes:

a switch housing on said mask body for mounting said reed switch for selective movement of said switch relative to the magnet to vary the magnitude of said magnetic field applied to said reed switch.

3. The breathing mask of claim 1 wherein:

said bias element is in the form of a ferromagnetic member mounted on said mask body adjacent said magnet, said ferromagnetic member being under the influence of said magnetic field, applying an attractive force to said magnet to normally draw said magnet toward said magnetically attractive member to urge said vane toward said normal position, and upon impingement of said predetermined flow stream on said vane, overcome said attractive force to move said vane from said normal position to said displaced position.

4. The breathing mask of claim 1 wherein:

said reed switch includes a stationary electrical contact member and a movable electrical contact member, said contact members being normally in contact to define said actuation position for completing an electrical circuit to activate said microphone, and said movable contact member responsive to said predetermined magnetic field to move from said actuation position to said attenuation position to break said electrical circuit and deactivate said microphone.

5. The breathing mask of claim 1 wherein:

said mask body includes a pivot mount; and said vane includes at least one pivot pin engaging said pivot mount to carry said vane pivotally from said body.

6. The breathing mask of claim 1 wherein:

said reed switch is mounted to said body by an adjustable switch mount for adjustably repositioning said switch relative to said magnet.

7. The breathing mask of claim 1 wherein:

said body includes a supply fitting connected with said gas inlet port for receipt of breathing gas to be introduced to said wearer's breathing passages.

8. The breathing mask of claim 1 wherein:

said reed switch includes a tubular barrel, a pair of contact members in said barrel and having respective base elements, a pair of electrically conductive coil springs flanking said barrel and connected with said base elements, said coil springs further including respective mounting rings and electrically conductive mounting screws mounting the respective said rings from said body.

9. The breathing mask of claim 1 wherein:

said bias member is in the form of a ferromagnetic element mounted on said body adjacent said magnet to, when said vane is in said normal position, be disposed within the magnetic field of said magnet to generate a relatively strong predetermined magnetic attraction with said magnet and to, when said vane is shifted to said displaced position, be disposed relative to said magnet so as to cooperate with said magnet in forming a magnetic attraction less than said predetermined magnetic attraction.

10. The breathing mask of claim 1 wherein:

said vane is elongated and includes an impingement pad on one end and a counterbalance at the opposite end, said pad positioned adjacent said port in the path of said flow stream;

said vane further including a pivot axis intermediate said impingement pad and said counterbalance and positioned to balance the weight of said vane thereon and wherein said mask includes;

pivot means for pivotally mounting said vane from said body for pivoting of said vane about said pivot axis between said normal position and said displaced position.

11. The breathing mask of claim 1 wherein:

said reed switch includes an elongated barrel defining a switch body and having first and second ends;

said body includes a switch mounting bracket formed with a threaded bore telescopically receiving said first end of said barrel;

a spring mount resiliently connecting said second end of said barrel from said body; and a threaded adjustment screw in said threaded bore and adjustable to shift the position of said barrel against the bias of said spring mount and relative to said magnet.

12. An improvement in a method for attenuating transmission of a microphone signal from a microphone housed in a breathing mask, the method of attenuating transmission, including providing a microphone receiving sounds from a mask wearer and transmitting signals representative thereof, the mask including an inlet gas port for flow of gas, providing a switch mounted in the mask responsive to a magnetic field to switch from an actuation position to an attenuation position to attenuate said transmissions of said microphone, and providing an actuation vane pivotally mounted on said mask to be disposed adjacent said inlet port and having a magnet mounted thereon to be disposed adjacent said switch for applying said magnetic field thereto, the improvement in said method comprising:

attenuating a breathing mask microphone signal upon inhalation of a gas by a wearer when a predetermined stream of gas impinges upon a vane to pivot the vane, shifting a magnet to apply a magnetic field to a reed switch to switch from an actuation position to an attenuation position.

13. A microphone signal attenuating breathing mask to be placed over a wearer's face and comprising:

a mask body including an inlet gas port to be disposed in flow communication with the wearer's breathing passage for, upon inhalation of a gas by the wearer, flow a predetermined stream of breathing gas;

a microphone for receiving sounds from said wearer and to produce transmissions related thereto;

an attenuation device for attenuating said transmissions of said microphone;

an electromagnetic switch coupled with said attenuation device including stationary and movable electrical contact members normally in contact to define an actuation position for completing an electrical circuit to produce said transmissions, and said movable contact member responsive to a predetermined magnetic field to move from said actuation position to an attenuation position to break said electrical circuit and attenuate said transmissions;

an activating magnet disposed adjacent said switch shiftable to a deactivating position to apply said magnetic field to move said movable contact member from said actuation position to said attenuation position;

a vane pivotally mounted on said mask body mounting said activating magnet and including an impingement pad positioned in said flow stream, said vane having a normal position disposing said magnet in said activating position and a displaced position disposing said magnet in said deactivating position;

a bias element on said body for biasing said vane to said normal position; and said vane being responsive to impingement of said predetermined stream to said impingement pad to overcome said bias and shift said vane to said displaced position.

14. The breathing mask of claim 13 wherein:

a switch housing on said mask body and mounting said electromagnetic switch for selective movement of said switch relative to the magnet to vary the magnitude of said magnetic field applied to said electromagnetic switch.

15. The breathing mask of claim 13 wherein:

said bias element is in the form of a ferromagnetic member mounted on said body adjacent said magnet, said member under the influence of said magnetic field, applying an attractive force to said magnet to normally draw said magnet toward said magnetically attractive member to urge said vane toward said normal position, and upon impingement of said predetermined flow stream on said vane, overcome said attractive force to move said vane from said normal position to said displaced position.

16. A microphone signal attenuating breathing mask to be placed over a wearer's face, comprising:

a mask body including a gas inlet port to be disposed in flow communication with the wearer's breathing passage for flow of a gas in a predetermined flow stream therethrough upon inhalation by the wearer;

a microphone for receiving sounds from the wearer and to produce transmissions related thereto;

an attenuation device for attenuating said transmissions by said microphone;

a reed switch coupled with said attenuation device and responsive to a magnetic field of a predetermined strength to switch from an actuation position to an attenuation position, said reed switch including an elongated barrel defining a switch body and having first and second ends, said mask body including a switch mounting bracket formed with a threaded bore telescopically receiving said first end of said barrel, with a spring mount resiliently connecting said second end of said barrel from said body;

an activating magnet to apply said magnetic field disposed adjacent to said reed switch and shiftable between an activating position to a deactivating position, a threaded adjustment screw being provided in said threaded bore and adjustable to shift the position of said barrel against the bias of said spring mount and relative to said magnet;

a moveable vane mounting said activating magnet and having a normal position disposing said magnet in said activating position and a displaced position disposing said magnet in said deactivating position;

a bias element for biasing said vane to said normal position; and said vane being configured such that impingement of said predetermined air stream thereon is effective to shift said vane to said displaced position.

17. A microphone signal attenuating breathing mask to be placed over a wearer's face, comprising:

a mask body including a gas inlet port to be disposed in flow communication with the wearer's breathing passage for flow of a gas in a predetermined flow stream therethrough upon inhalation by the wearer;

a microphone for receiving sounds from the wearer and to produce transmissions related thereto;

an attenuation device for attenuating said transmissions by said microphone;

a reed switch coupled with said attenuation device and responsive to a magnetic field of a predetermined strength to switch from an actuation position to an attenuation position;

an activating magnet to apply said magnetic field disposed adjacent to said switch and shiftable between an activating position and a deactivating position;

a moveable vane mounting said activating magnet and having a normal position disposing said magnet in said activating position and a displaced position disposing said magnet in said deactivating position;

a bias element for biasing said vane to said normal position, said bias element being in the form of a ferromagnetic member mounted on said mask body adjacent to said magnet, said ferromagnetic member being under the influence of said magnetic field, applying an attractive force to said magnet to normally draw said magnet toward said magnetically attractive member to urge said vane toward said normal position, and upon impingement of said predetermined flow stream on said vane, to overcome said attractive force to move said vane from said normal position to said displaced position; and said vane being configured such that impingement of said predetermined air stream thereon is effective to shift said vane to said displaced position.

18. A microphone signal attenuating breathing mask to be placed over a wearer's face, comprising:

a mask body including a pivot mount and gas inlet port to be disposed in flow communication with the wearer's breathing passage for flow of a gas in a predetermined flow stream therethrough upon inhalation by the wearer;

a microphone for receiving sounds from the wearer and to produce transmissions related thereto;

an attenuation device for attenuating said transmissions by said microphone;

a reed switch coupled with said attenuation device and responsive to a magnetic field of a predetermined strength to switch from an actuation position to an attenuation position;

an activating magnet to apply said magnetic field disposed adjacent said switch and shiftable between an activating position and a deactivating position;

moveable vane including at least one pivot pin engaging said pivot mount to carry said vane pivotally from said body, said moveable vane mounting said activating magnet and having a normal position disposing said magnet in said activating position and a displaced position disposing said magnet in said deactivating position;

a bias element for biasing said vane to said normal position; and said vane being configured such that impingement of said predetermined air stream thereon is effective to shift said vane to said displaced position.

19. A microphone signal attenuating breathing mask to be placed over a wearer's face, comprising:

a mask body including a gas inlet port to be disposed in flow communication with the wearer's breathing passage for flow of a gas in a predetermined flow stream therethrough upon inhalation by the wearer;

a microphone for receiving sounds from the wearer and to produce transmissions related thereto;

an attenuation device for attenuating said transmissions by said microphone;

a reed switch coupled with said attenuation device and responsive to a magnetic field of a predetermined strength to switch from an actuation position to an attenuation position, said reed switch including a tubular barrel, a pair of contact members in said barrel and having respective base elements, a pair of electrically conductive coil springs flanking said barrel and connected with said base elements, said coil springs further including respective mounting rings and electrically conductive mounting screws mounting said rings from said body, respectively;

an activating magnet to apply said magnetic field disposed adjacent to said switch and shiftable between an activating position to a deactivating position;

a moveable vane mounting said activating magnet and having a normal position disposing said magnet in said activating position and a displaced position disposing said magnet in said deactivating position;

a bias element for biasing said vane to said normal position; and said vane being configured such that impingement of said predetermined air stream thereon is effective to shift said vane to said displaced position.

20. A microphone signal attenuating breathing mask to be placed over a wearer's face, comprising:

a mask body including a gas inlet port to be disposed in flow communication with the wearer's breathing passage for flow of a gas in a predetermined flow stream therethrough upon inhalation by the wearer;

a microphone for receiving sounds from the wearer and to produce transmissions related thereto;

an attenuation device for attenuating said transmissions by said microphone;

a reed switch coupled with said attenuation device and responsive to a magnetic field of a predetermined strength to switch from an actuation position to an attenuation position;

an activating magnet to apply said magnetic field disposed adjacent to said switch and shiftable between an activating position to a deactivating position;

a moveable vane mounting said activating magnet and having a normal position disposing said magnet in said activating position and a displaced position disposing said magnet in said deactivating position;

a bias element for a biasing said vane to said normal position, said bias element being in the form of a ferromagnetic element mounted on said body adjacent to said magnet to be disposed within the magnetic field of said magnet when said vane is in said normal position, to generate a relatively strong predetermined magnetic attraction with said magnet, and to be disposed relative to said magnet when said vane is shifted to said displaced position, so as to cooperate with said magnet in forming a magnetic attraction less than said predetermined magnetic attraction; and said vane being configured such that impingement of said predetermined air stream thereon is effective to shift said vane to said displaced position.

21. A microphone signal attenuating breathing mask to be placed over a wearer's face, comprising:

a mask body including a gas inlet port to be disposed in flow communication with the wearer's breathing passage for flow of a gas in a predetermined flow stream therethrough upon inhalation by the wearer;

a microphone for receiving sounds from the wearer and to produce transmissions related thereto;

an attenuation device for attenuating said transmissions by said microphone;

a reed switch coupled with said attenuation device and responsive to a magnetic field of a predetermined strength to switch from an actuation position to an attenuation position;

an activating magnet to apply said magnetic field disposed adjacent to said switch and shiftable between an activating position to a deactivating position;

an elongated moveable vane mounting said activating magnet, said elongated vane including an impingement pad on one end and a counter balance at the opposite end, said pad positioned adjacent said port in the path of said flow stream, said vane including a pivot axis intermediate said impingement pad and said counter balance and positioned to balance the weight of said vane thereon, said elongated moveable vane having a normal position disposing said magnet in said activating position and a displaced position disposing said magnet in said deactivating position, and said elongated vane including pivot means for pivotally mounting said vane from said body for pivoting of said vane about said pivot axis between said normal position and said displaced position;

a bias element for biasing said vane to said normal position; and said vane being configured such that impingement of said predetermined air stream thereon is effective to shift said vane to said displaced position.

* * * * *